US007310969B2

(12) United States Patent
Dale

(10) Patent No.: US 7,310,969 B2
(45) Date of Patent: Dec. 25, 2007

(54) CONTROLLED-ENVIRONMENT CARGO CONTAINER

(75) Inventor: Robert Dale, Vancouver (CA)

(73) Assignee: Coldwall, Inc., Bellevue, WA (US)

( * ) Notice: Subject to any disclaimer, the term of this patent is extended or adjusted under 35 U.S.C. 154(b) by 0 days.

(21) Appl. No.: 11/194,121

(22) Filed: Jul. 29, 2005

(65) Prior Publication Data

US 2006/0060659 A1 Mar. 23, 2006

Related U.S. Application Data

(63) Continuation of application No. 10/714,589, filed on Nov. 13, 2003, now abandoned.

(60) Provisional application No. 60/427,146, filed on Nov. 15, 2002.

(51) Int. Cl.

| | |
|---|---|
| ***F25D 17/04*** | (2006.01) |
| ***F25D 11/00*** | (2006.01) |
| ***A23B 4/03*** | (2006.01) |
| ***B60H 1/00*** | (2006.01) |

(52) U.S. Cl. ..... 62/407; 62/408; 62/417; 62/440; 99/474; 454/118

(58) Field of Classification Search ..... 236/44 L; 62/407, 408, 417, 440; 99/473, 474; 454/118
See application file for complete search history.

(56) References Cited

U.S. PATENT DOCUMENTS

| | | | | |
|---|---|---|---|---|
| 5,101,643 | A * | 4/1992 | Hicke | 62/407 |
| 5,460,013 | A | 10/1995 | Thomsen | |
| 5,671,609 | A | 9/1997 | Lionetti | |
| 5,791,150 | A * | 8/1998 | Bosher et al. | 62/62 |
| 5,830,057 | A | 11/1998 | Hunt, Jr. | |
| 5,946,933 | A | 9/1999 | Clarke et al. | |
| 6,012,384 | A | 1/2000 | Badalament et al. | |
| 6,077,160 | A | 6/2000 | Franaszek et al. | |
| 6,151,908 | A | 11/2000 | Graaff | |
| 6,164,085 | A | 12/2000 | Clarke et al. | |
| 6,269,652 | B1 | 8/2001 | Grosskopf | |
| 6,296,561 | B1 | 10/2001 | Ziegler et al. | |
| 6,422,031 | B1 | 7/2002 | Mandel et al. | |
| 6,457,402 | B1 | 10/2002 | Parker et al. | |
| 6,508,076 | B1 | 1/2003 | Gast et al. | |
| 2004/0144124 | A1 | 7/2004 | Bottom | |

* cited by examiner

*Primary Examiner*—Marc Norman
(74) *Attorney, Agent, or Firm*—Lerner, David, Littenberg, Krumholz & Mentlik, LLP

(57) ABSTRACT

A method and apparatus for controlling the environment of cargo through lateral ventilation. The method provides for a controlled fluid to be supplied into a cargo compartment having a lateral portion, the fluid being supplied through a vent in a supply-conduit adjacent the lateral portion. In practice, this result can be achieved by building a structure that encloses a cargo compartment having a lateral portion, running a supply-conduit adjacent the lateral portion, connecting the supply-conduit to receive a controlled fluid from outside the cargo compartment, and conducting the fluid into the cargo compartment through a vent in the supply-conduit. On mixing with the environment within the cargo compartment, the fluid will influence components of the environment, for example the humidity and the temperature.

29 Claims, 8 Drawing Sheets

CONTROLLED-ENVIRONMENT CARGO CONTAINER

CROSS-REFERENCE TO RELATED APPLICATION

This application is a continuation of U.S. patent application Ser. No. 10/714,589, filed Nov. 13, 2003, now abandoned which claims the benefit of U.S. Provisional Patent Application No. 60/427,146, filed Nov. 15, 2002.

BACKGROUND OF THE INVENTION

Field of the Invention

The present invention relates to controlled-environment cargo containers, and more particularly to a method and apparatus for controlling components of a cargo container's environment, for example temperature and humidity.

SUMMARY OF THE INVENTION

The present invention is directed to configuring cargo containers to promote a horizontal flow in the container environment. As an additional benefit, when containers are so configured, certain expensive and ineffective components typically required in conventional containers may be omitted.

BRIEF DESCRIPTION OF THE DRAWINGS

These and other objects, features and advantages of the present invention will become more readily apparent upon considering the following detailed description of specific embodiments, with reference to the accompanying drawings where like numbers reference like elements, in which.

DETAILED DESCRIPTION

1. Structure

Figure 1:
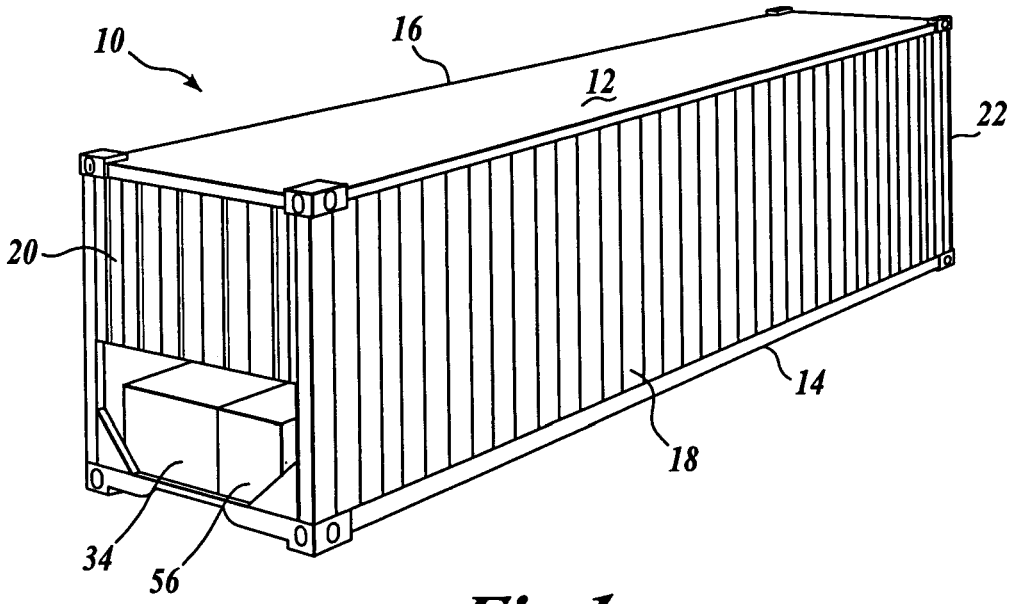
FIG. 1 is a perspective side view of a cargo container according to one embodiment of the present invention.

Referring first to FIGS. 1 through 4, a cargo container according to one embodiment of the present invention is generally illustrated at 10. The cargo container includes a roof assembly 12, a floor assembly 14, first and second opposing side assemblies 16, 18, and first and second opposing end assemblies 20, 22 that cooperate to form an enclosed cargo compartment 24. It will be appreciated that the cargo compartment 24 could be enclosed by a different arrangement of assemblies without departing from the spirit of the invention. In this embodiment, the second end assembly includes a door sub-assembly 26 which has an open position to provide access to the cargo compartment 24 and an alternative closed position to seal the cargo compartment 24.

At least one of the first and second side assemblies 16, 18 includes a lateral portion 28 within the cargo compartment 24.

The cargo container 10 further includes a supply-conduit 30 adjacent the lateral portion 28 of the cargo compartment 24. The supply-conduit 30 is placed, arranged, fitted and otherwise adapted to receive therewithin a fluid from outside the cargo compartment 24. In this embodiment, the supply-conduit 30 is formed integrally from the structure of the cargo container 10, and more particularly is illustrated as an integral portion of the first side assembly 16.

The supply-conduit 30 includes a vent 32 passing radially therethrough and adapted to conduct the fluid within the supply-conduit 30 into the cargo compartment 24. In this embodiment, the fluid conducted by the supply-conduit is substantially air.

Although the supply-conduit 30 is operable so as to ventilate the cargo compartment 24 with fluid received from outside the cargo compartment 24, the cargo container 10 may also include a controller 34 having an input port 36 adapted to receive a fluid and an output port 38 adapted to supply the fluid received at the input port 36. The controller 34 is operable to urge an environmental component of the fluid supplied at the output port 38 toward a desired value. For example, the controller 34 might include a heater 40 for increasing the temperature of the fluid, a cooler 42 for decreasing the temperature of the fluid, a humidifier 44 for increasing the humidity of the fluid, or a dehumidifier 46 for decreasing the humidity of the fluid. These aspects are shown diagrammatically in FIG. 2, for example. In this embodiment, the output port 38 of the controller 34 is connected to supply fluid to the supply-conduit 30 so as to provide more control over the environment within the cargo compartment 24.

The cargo container 10 may additionally include a return-conduit 50 having a first end 52 connected to the cargo compartment 24 and a second end 54 connected to the input port 36 of the controller 34. So arranged, the return-conduit 50 is operable to conduct fluid from the cargo container 24 to the controller 34, so as to form a closed system with the supply-conduit 30 and the controller 34 for controlling and recirculating fluid. In this embodiment, the return-conduit 50 follows along the roof assembly 12; however, other placements would be possible without departing from the spirit of the invention.

The cargo container 10 may further include a pump or fan 56 connected in series with the supply-conduit 30, the controller 34 and the return-conduit 50. The pump or fan 56 is operable to provide additional motive force for circulating the fluid, beyond any thermodynamic forces otherwise present in the passive system formed by the supply-conduit 30, the controller 34 and the return-conduit 50.

Finally, because no ducting need follow along the floor assembly 14, there is no need to include T-rail floor panels. Thus in this embodiment, the floor assembly 14 includes a simple and robust corrugated floor 58.

Figure 5:
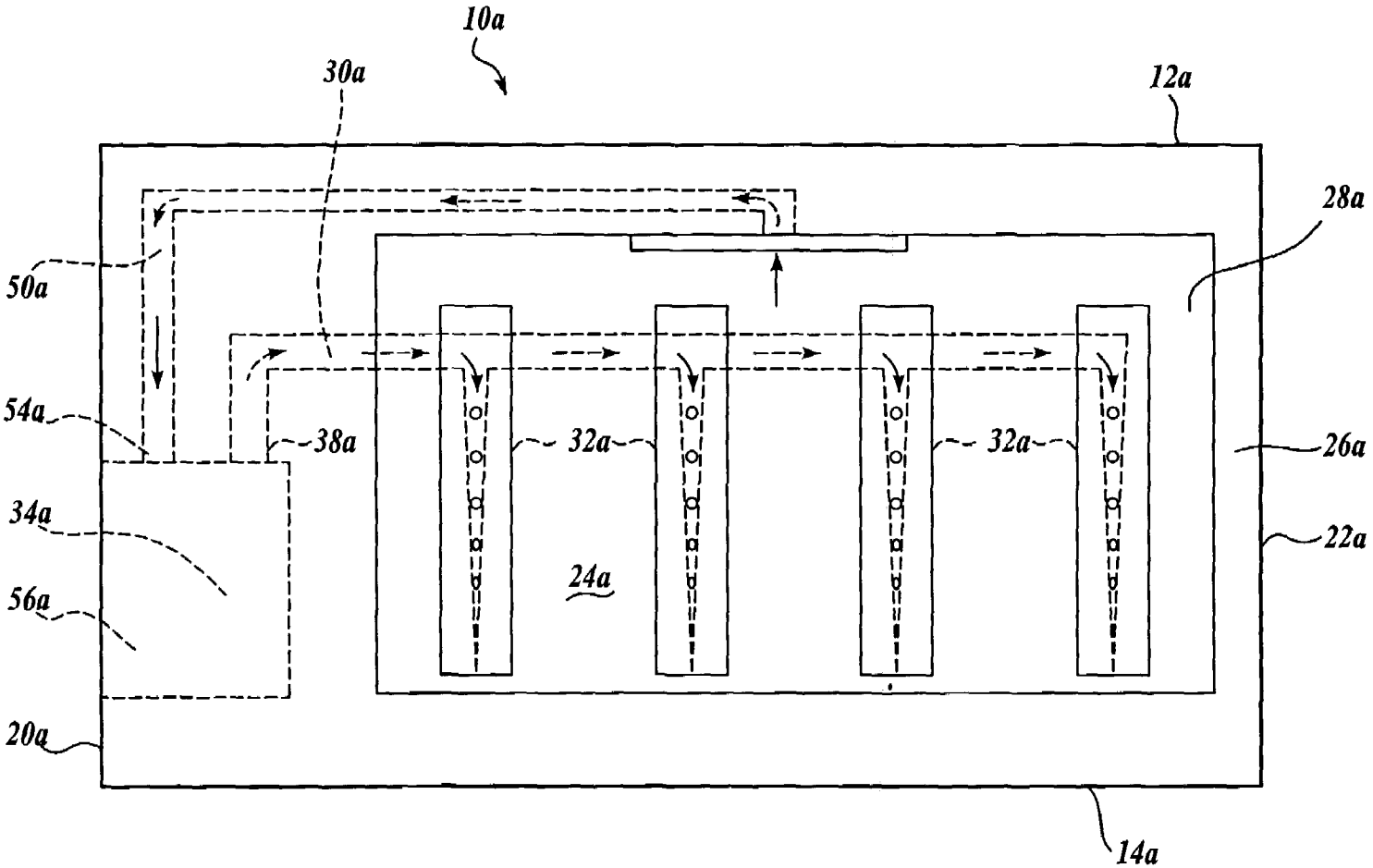
FIG. 5 is a longitudinal sectional view of a cargo container according to a second embodiment of the invention, looking from a second side toward a first side, a vertical cutting plane having removed the first side from this view.

Referring now to FIG. 5, a cargo container according to a second embodiment of the invention is generally illustrated at 10*a*. In this embodiment, the vent 32*a* is elongated and oriented substantially vertically within the cargo compartment 24*a*. The vent 32*a* may extend substantially from the top of the cargo compartment 24*a* proximate the roof assembly 12*a* to the bottom of the cargo compartment 24*a* proximate the floor assembly 14*a*. The vent 32*a* defines a plurality of holes 60*a* through the supply-conduit 30*a* that are each adapted to conduct fluid within the supply-conduit 30*a* into the cargo compartment 24*a*.

Figure 6:
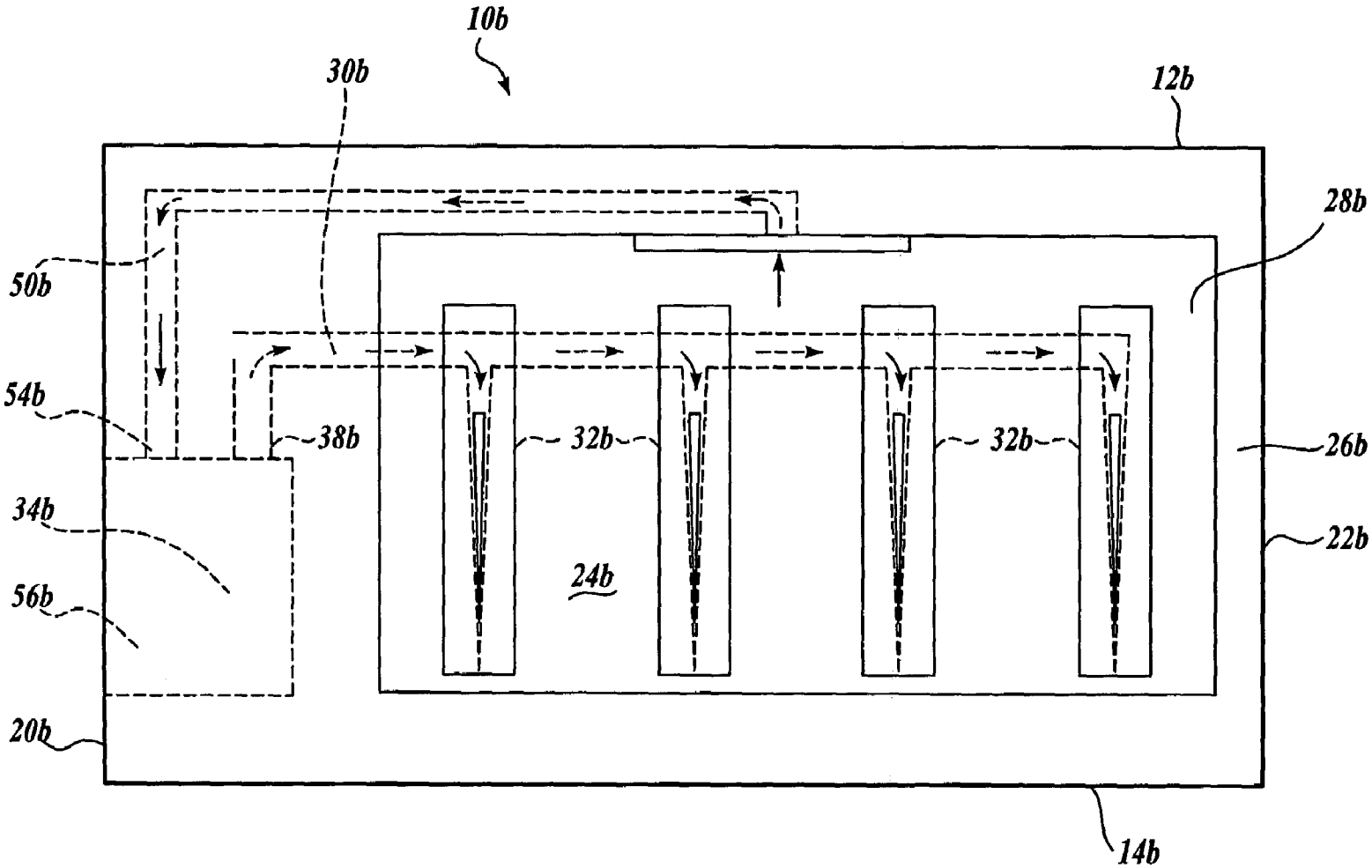
FIG. 6 is a longitudinal sectional view of a cargo container according to a third embodiment of the invention, looking from a second side toward a first side, a vertical cutting plane having removed the first side from this view.

Referring now to FIG. 6, a cargo container according to a third embodiment of the invention is generally illustrated at 10*b*. In this embodiment, the vent 32*b* is also elongated and oriented substantially vertically within the cargo compartment 24*b* and may extend substantially from the top of the cargo compartment 24*b* proximate the roof assembly 12*b* to the bottom of the cargo compartment 24*b* proximate the floor assembly 14*b*. However, in this third embodiment, the vent 32*b* defines an elongated slot 60*b* through the supply-conduit 30*b* that is adapted to conduct fluid within the supply-conduit 30*a* into the cargo compartment 24*b*.

Referring briefly to both FIGS. 5 and 6, the interior cross-section of the supply-conduit 30*a*, 30*b* may vary inversely with the distance between the cross-section and the fluid supply at the output port 38*a*, 38*b* of the controller 34*a*, 34*b* as measured along the longitudinal axis of the supply-conduit 30*a*, 30*b*. This decreasing interior cross-section at portions of the supply-conduit 30*a*, 30*b* remote from the controller 34*a*, 34*b* helps to make the pressure of fluid within the supply-conduit 30*a*, 30*b* more uniform throughout its length.

Figure 7:
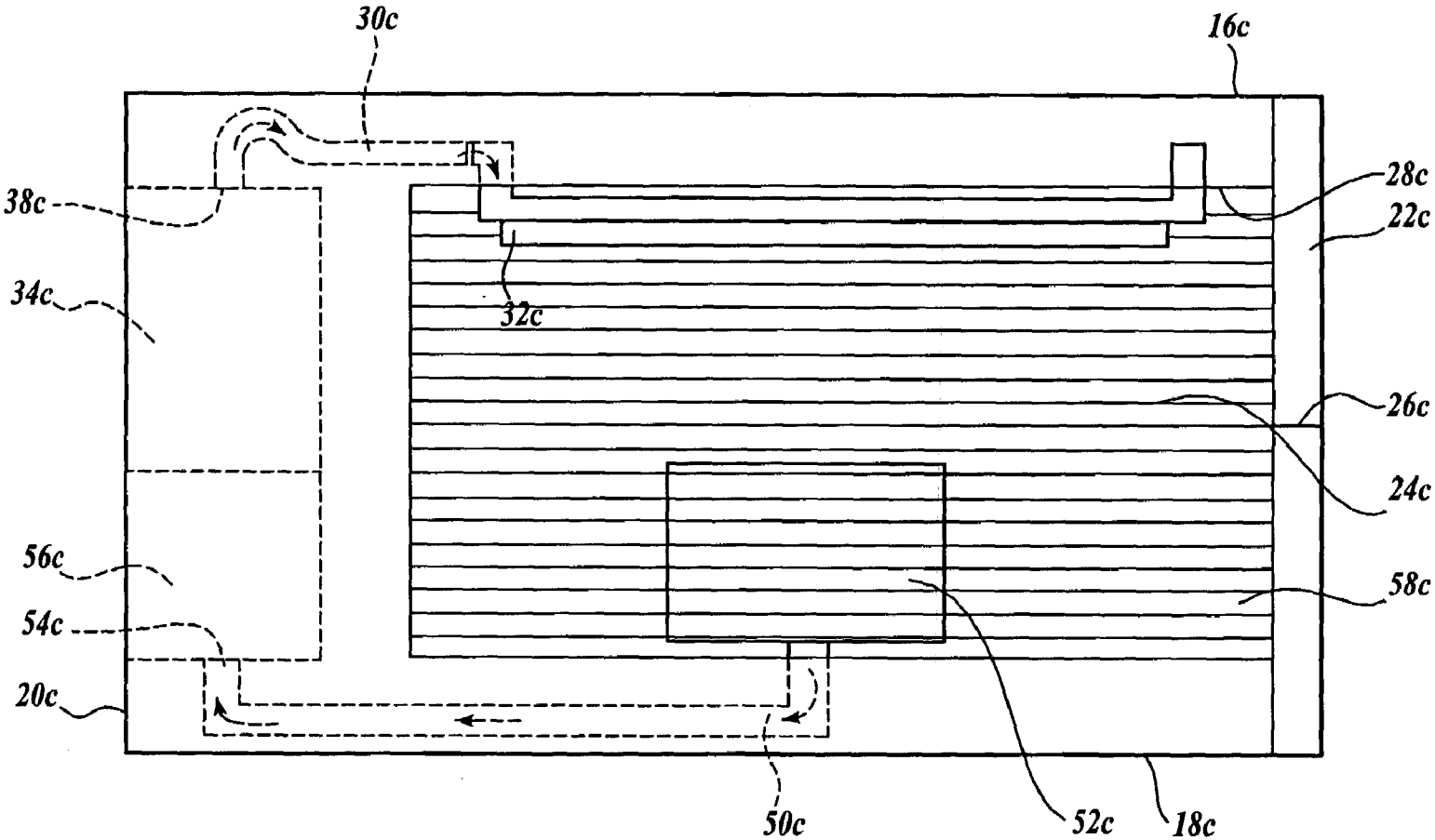
FIG. 7 is a plan sectional view of a cargo container according to a fourth embodiment of the invention, a horizontal cutting plane passing through a roof assembly.

Referring now to FIG. 7, a cargo container according to a fourth embodiment of the invention is generally illustrated at 10*c*. In this embodiment, the supply-conduit 30*c* is an independent assembly separate from the structure of the cargo container 10*c*. The supply-conduit 30*c* may be attached to the cargo container 10*c*, and as illustrated is attached to the lateral portion 28*c* of the cargo compartment 24*c*.

Figure 2:
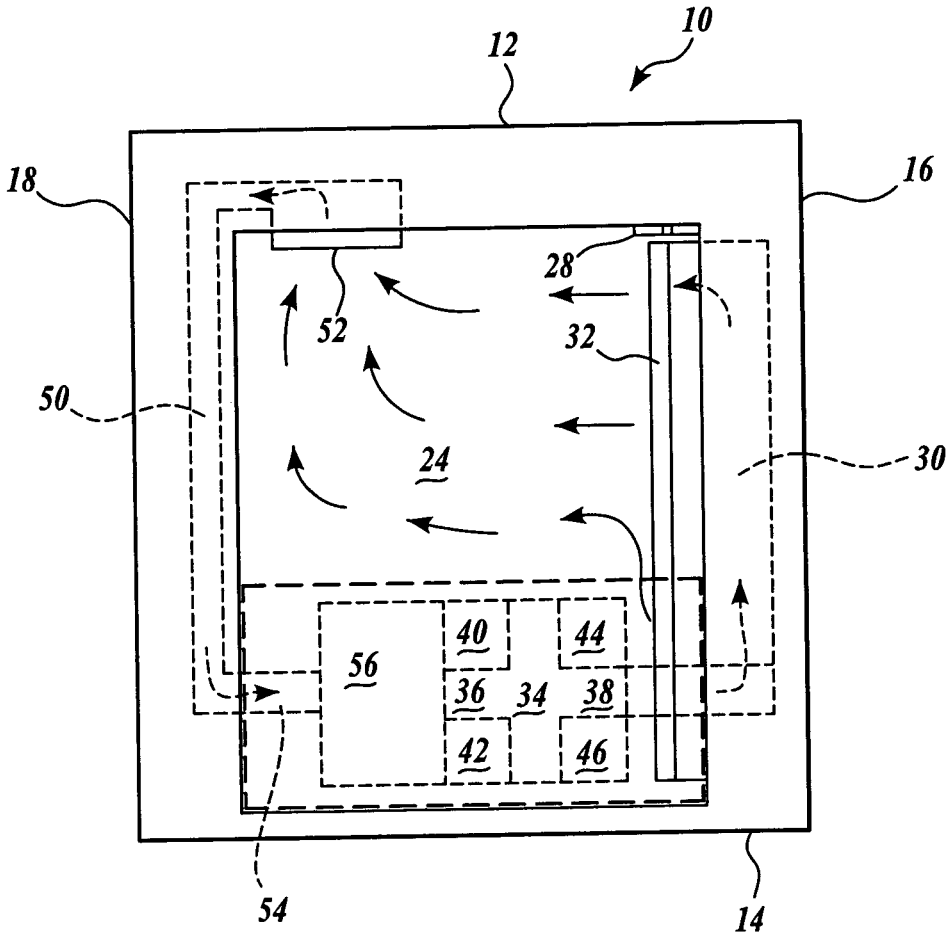
FIG. 2 is a transverse sectional view of the cargo container of FIG. 1, looking from a second end toward a first end.
Figure 3:
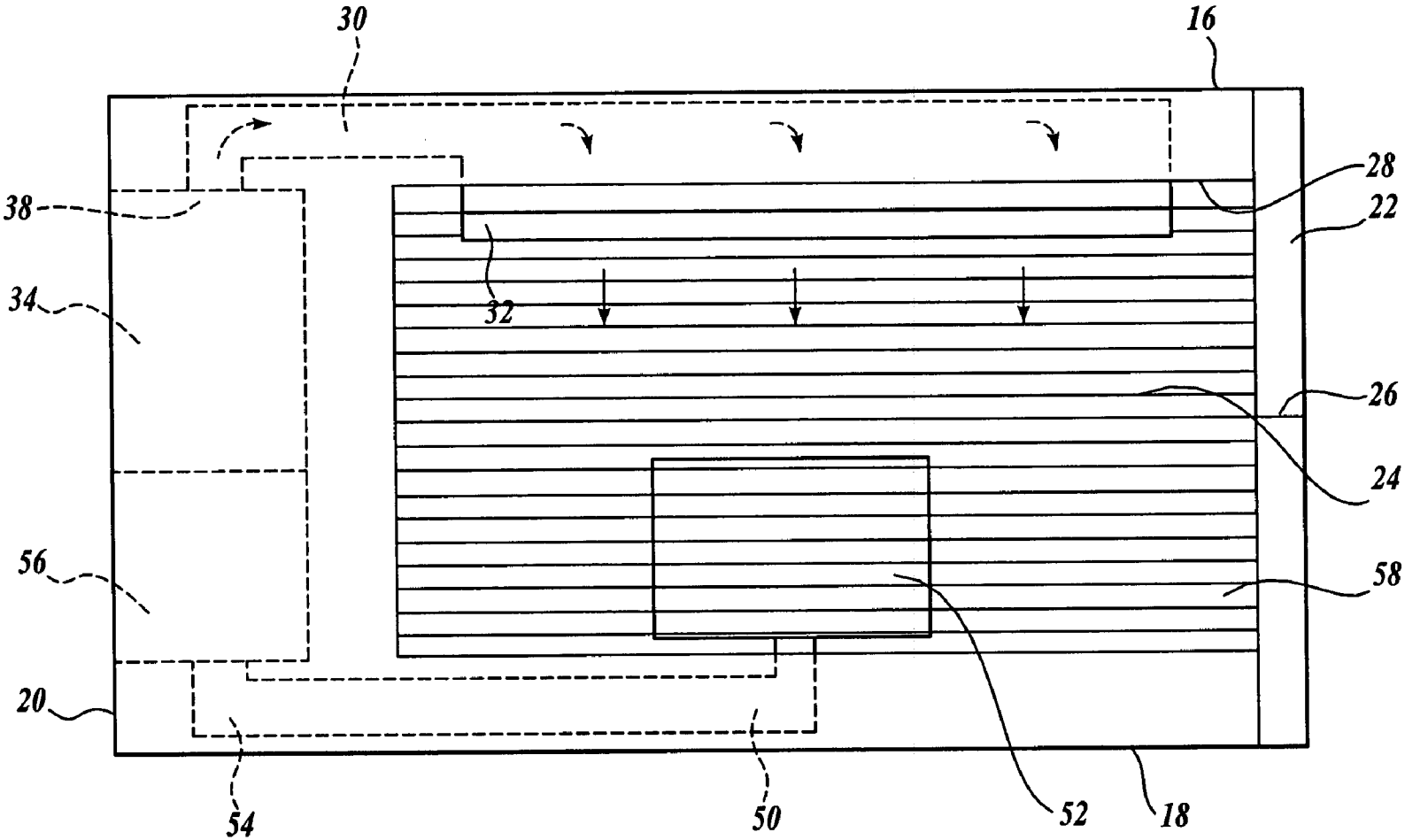
FIG. 3 is a plan sectional view of the cargo container of FIG. 1, a horizontal cutting plane passing through a roof assembly.
Figure 4:
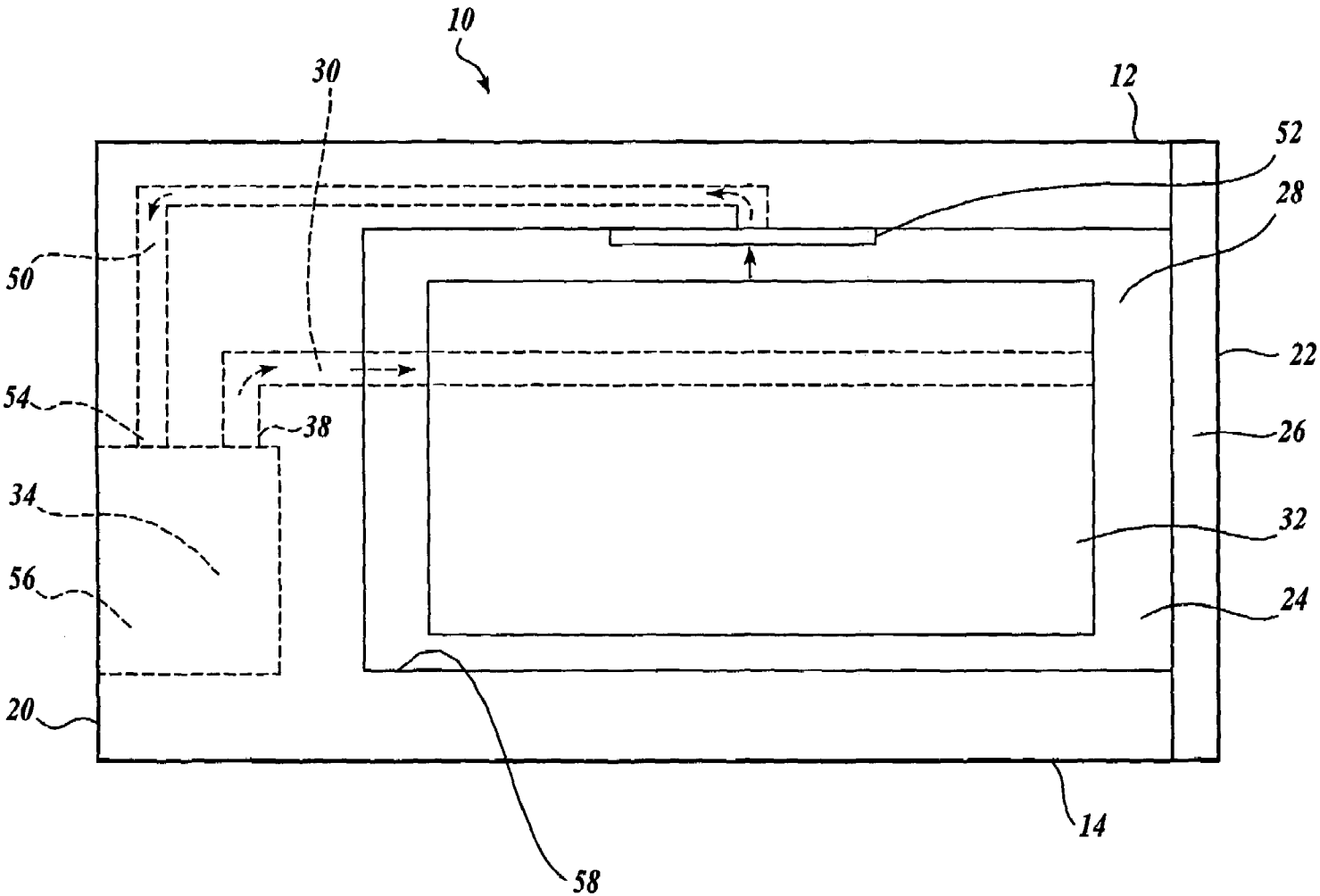
FIG. 4 is a longitudinal sectional view of the cargo container of FIG. 1, looking from a second side toward a first side, a vertical cutting plane having removed the first side from this view.

Referring briefly now to FIGS. 2 and 7, it can be observed that the supply conduit 30, 30*c* in the first and fourth embodiments is substantially within the cargo compartment 24, 24*c*.

Figure 8:
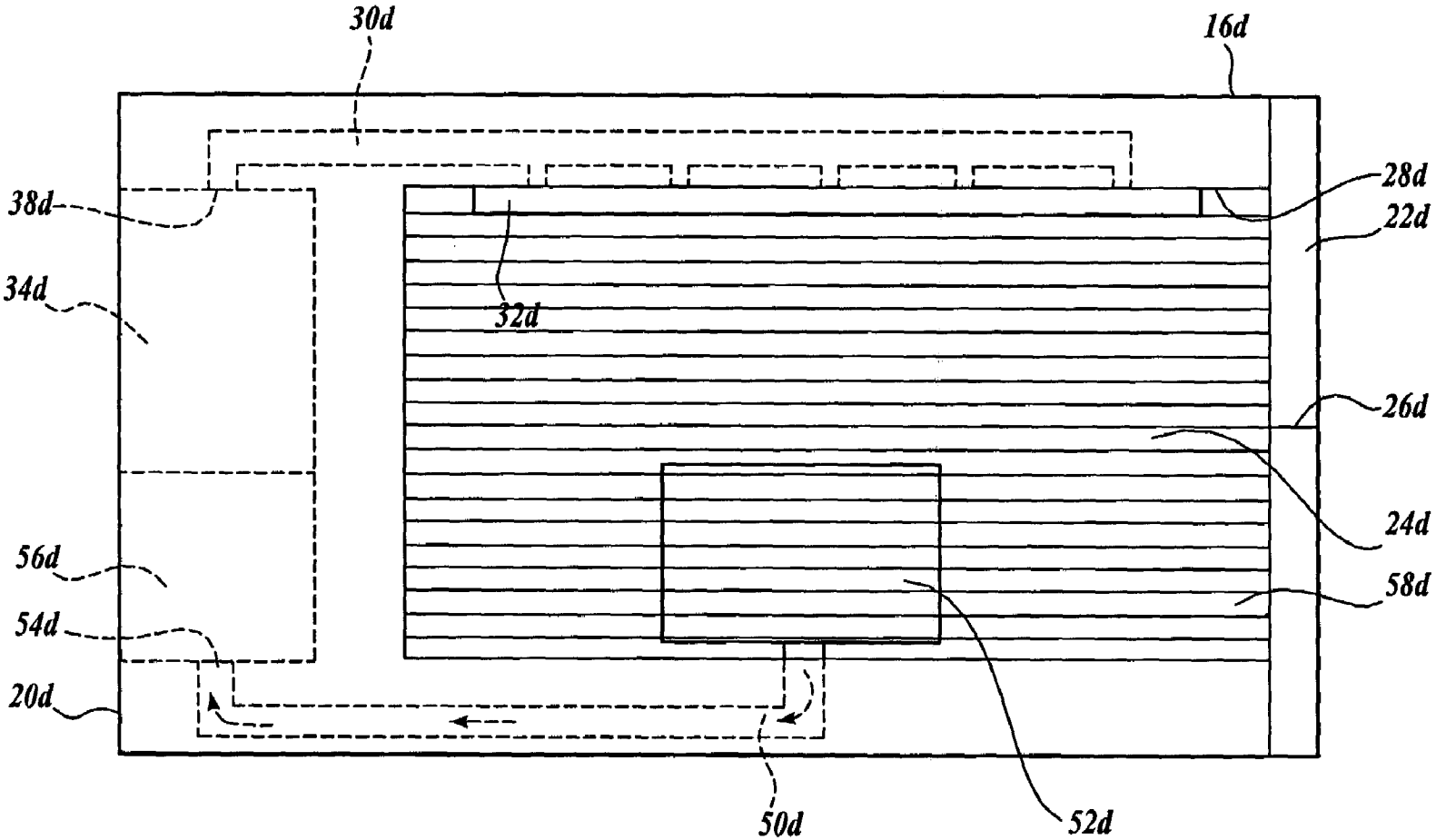
FIG. 8 is a plan sectional view of a cargo container according to a fifth embodiment of the invention, a horizontal cutting plane passing through a roof assembly.

Referring now to FIG. 8, a cargo container according to a fifth embodiment of the invention is generally illustrated at 10*d*. Just as in the first embodiment of the cargo container 10, the supply-conduit 30*d* is formed integrally from the structure of the cargo container 10*d*, and more particularly is illustrated as an integral portion of the first side assembly 16*d*. However, in the case of the fifth embodiment, the supply-conduit 30*d* is substantially outside the cargo compartment 24*d*.

Figure 9:
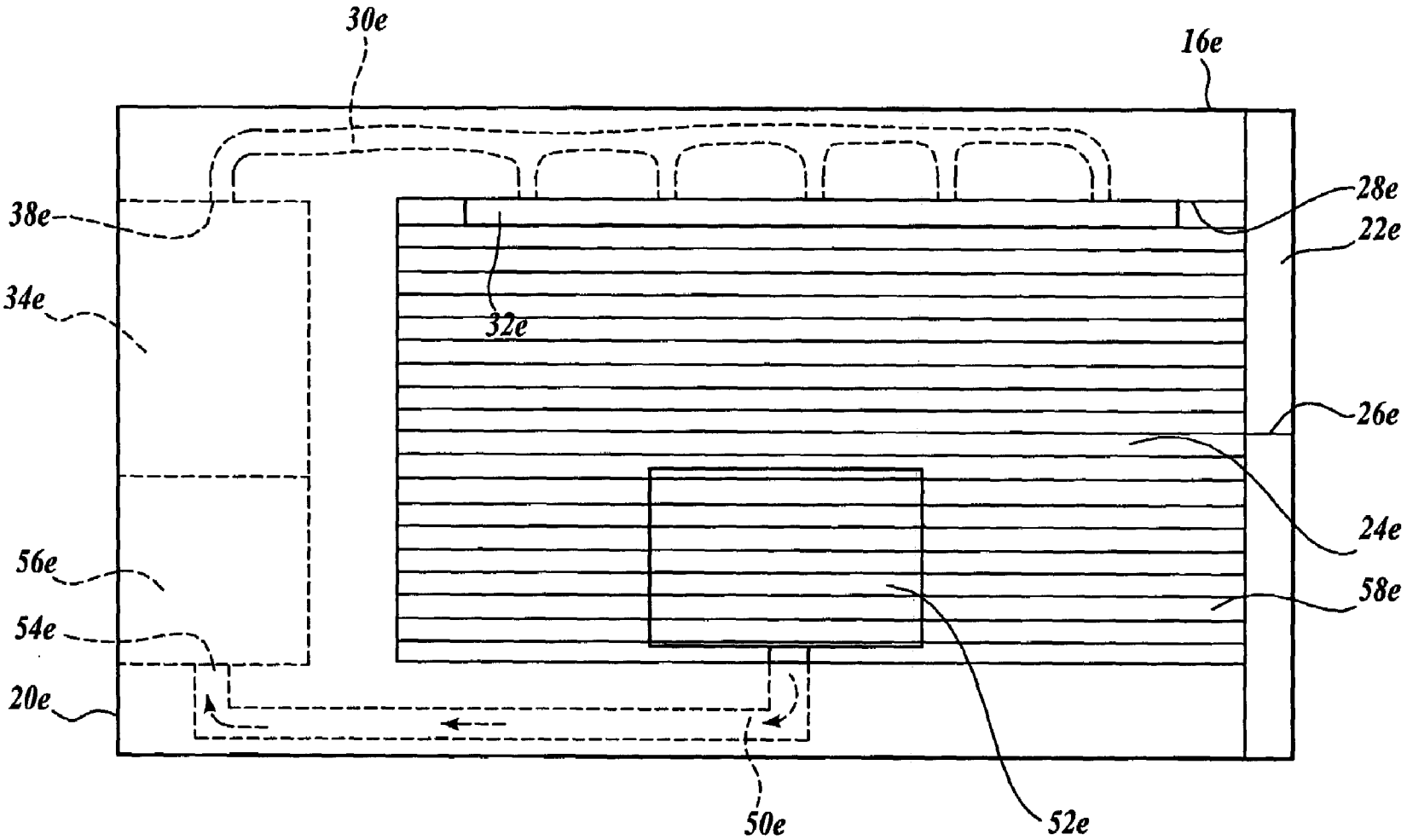
FIG. 9 is a plan sectional view of a cargo container according to a sixth embodiment of the invention, a horizontal cutting plane passing through a roof assembly.

Referring finally now to FIG. 9, a cargo container according to a sixth embodiment of the invention is generally illustrated at 10*e*. Just as in the fourth embodiment of the cargo container 10*c*, the supply-conduit 30*e* is an independent assembly separate from the structure of the cargo container 10*c*. However, while the supply-conduit 30*e* may be attached to the cargo container 10*c*, in this sixth embodiment it is substantially outside the cargo compartment 24*e*.

2. Operation

Referring now to FIGS. 1 through 9, the operation of the six embodiments of the cargo container 10, 10*a*, 10*b*, 10*c*, 10*d*, 10*e* will now be described. Except when reference is being made specifically to an alternate feature of one of the alternate embodiments, the alphabetic suffixes will be omitted from all reference numbers for the purpose of simplicity.

With the door sub-assembly 26 placed in its open position, the cargo compartment 24 is made accessible for loading cargo. The corrugated floor 58 incorporated into the floor assembly 14 provides a robust surface for loading and securing the cargo and the corrugations help to carry any water that may accumulate within the cargo compartment 24 away from the cargo. Once the cargo has been loaded into the cargo compartment 24, the door sub-assembly 26 is placed in its closed position to seal the cargo compartment 24.

Either during loading or after the cargo compartment 24 has been sealed, an operator can set the controller 34 to urge an environmental component of the fluid supplied at the output port 38 toward a desired value, for example a desired temperature or humidity. The operator can also engage the pump or fan 56 to provide motive force to circulate the fluid through the controller 34 to the supply-conduit 30, on through the vent 32 into the cargo compartment 24, and then back through the return-conduit 50 to the controller 34.

With the supply-conduit 30, the vent 32, and the return-conduit 50 being oriented as previously described, the fluid flow through the cargo compartment 24 has a significant horizontal component, as is advantageously found in warehouse facilities.

While specific embodiments of the invention have been described and illustrated, such embodiments should be considered illustrative of the invention only.

What is claimed is:

1. A cargo container, comprising:

a structure that defines a cargo compartment having a ceiling, a floor and a lateral portion;

a controller positioned outside of the cargo compartment;

a supply conduit adjacent the lateral portion and having an inlet for receiving a fluid from the controller, and an outlet spaced above the floor for supplying the fluid to the cargo compartment; and a return conduit having an inlet for receiving the fluid from the cargo compartment through the ceiling of the cargo compartment and an outlet for supplying the fluid to the controller.

2. A cargo container as claimed in claim 1, wherein the controller is operable to urge an environmental component of the fluid toward a desired value.

3. A cargo container as claimed in claim 2, wherein the environmental component is temperature.

4. A cargo container as claimed in claim 2, wherein the environmental component is humidity.

5. A cargo container as claimed in claim 1, further comprising a pump connected in series with the controller, the supply conduit, and the return conduit and operable to urge the fluid therethrough.

6. A cargo container as claimed in claim 5, wherein the fluid comprises air.

7. A cargo container as claimed in claim 1, wherein the floor of the cargo compartment is corrugated.

8. A cargo container as claimed in claim 1, wherein the outlet of the supply conduit includes a substantially vertically oriented elongated vent for discharging the fluid from the supply conduit into the cargo compartment.

9. A cargo container as claimed in claim 8, wherein the vent extends from substantially the top of the cargo compartment to substantially the bottom of the cargo compartment.

10. A cargo container as claimed in claim 8, wherein the vent includes a plurality of holes in the lateral portion of the cargo compartment adapted to discharge the fluid from the supply conduit into the cargo compartment.

11. A cargo container as claimed in claim 8, wherein the vent includes an elongated slot in the lateral portion of the cargo compartment adapted to discharge the fluid from the supply conduit into the cargo compartment.

12. A cargo container as claimed in claim 1, wherein the supply conduit has an interior cross-section, and the size of the cross-section decreases gradually along the length of the supply conduit from the inlet of the supply conduit to the outlet of the supply conduit.

13. A cargo container as claimed in claim 1, wherein the supply conduit is formed integrally with the structure.

14. A cargo container as claimed in claim 1, wherein the supply conduit is separate from the structure.

15. A cargo container as claimed in claim 14, wherein the supply conduit is attached to the lateral portion of the cargo compartment.

16. A cargo container as claimed in claim 1, wherein the supply conduit is substantially outside the cargo compartment.

17. A cargo container as claimed in claim 1, wherein the supply conduit is substantially outside the cargo compartment.

18. A method of controlling the environment within a cargo compartment of a cargo container, the cargo compartment having a structure including a ceiling, a floor and a lateral portion, and the cargo container having a controller positioned outside of the cargo compartment, the method comprising:

supplying a fluid from the controller to the cargo compartment through a supply conduit adjacent the lateral portion, the supply conduit having an outlet spaced above the floor;

removing the fluid from the cargo compartment through the ceiling of the cargo compartment and into an inlet of a return conduit; and supplying the fluid from the return conduit to the controller.

19. A method as claimed in claim 18, further comprising controlling the temperature of the fluid supplied from the controller.

20. A method as claimed in claim 18, further comprising controlling the humidity of the fluid supplied from the controller.

21. A method as claimed in claim 18, wherein the fluid comprises air.

22. A method as claimed in claim 18, wherein the supply conduit has outlets at more than one elevation within the cargo compartment.

23. A method as claimed in claim 22, wherein the supply conduit has outlets at a plurality of discrete elevations within the cargo compartment.

24. A method as claimed in claim 22, wherein a substantially similar volume of the fluid is supplied at each of the more than one elevation within the cargo compartment.

25. A method as claimed in claim 18, wherein the supply conduit is formed integrally with the structure of the cargo compartment.

26. A method as claimed in claim 18, wherein the supply conduit is separate from the structure of the cargo compartment.

27. A method as claimed in claim 26, wherein the supply conduit is attached to the lateral portion of the cargo compartment.

28. A method as claimed in claim 18, wherein the supplying step includes supplying the fluid through a supply conduit substantially within the cargo compartment.

29. A method as claimed in claim 18, wherein the supplying step includes supplying the fluid through a supply conduit substantially outside the cargo compartment.

* * * * *

UNITED STATES PATENT AND TRADEMARK OFFICE

CERTIFICATE OF CORRECTION

PATENT NO. : 7,310,969 B2
APPLICATION NO. : 11/194121
DATED : December 25, 2007
INVENTOR(S) : Robert Dale It is certified that error appears in the above-identified patent and that said Letters Patent is hereby corrected as shown below:

Column 5, line 28, “outside” should read --within--.

Signed and Sealed this

Ninth Day of December, 2008

JON W. DUDAS
*Director of the United States Patent and Trademark Office*